US008327933B2

(12) United States Patent
Lynde et al.

(10) Patent No.: US 8,327,933 B2
(45) Date of Patent: Dec. 11, 2012

(54) ARRANGEMENT AND METHOD FOR SENDING AND/OR SEALING CEMENT AT A LINER HANGER

(75) Inventors: Gerald D. Lynde, Houston, TX (US); Douglas J. Murray, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/335,304

(22) Filed: Dec. 22, 2011

(65) Prior Publication Data

US 2012/0090836 A1 Apr. 19, 2012

Related U.S. Application Data

(63) Continuation of application No. 12/195,074, filed on Aug. 20, 2008, now abandoned.

(51) Int. Cl.
*E21B 33/13* (2006.01)

(52) U.S. Cl. ..... 166/253.1; 166/177.4; 166/250.41

(58) Field of Classification Search ..... 166/117.4, 166/250.14, 253.1, 177.4
See application file for complete search history.

(56) References Cited

U.S. PATENT DOCUMENTS

| | | | |
|---|---|---|---|
| 3,272,517 | A | 9/1966 | Howard et al. |
| 3,489,219 | A | 1/1970 | Higgins |
| 4,120,166 | A | 10/1978 | Brooks |
| 4,191,250 | A | 3/1980 | Messenger |
| 4,440,226 | A | 4/1984 | Suman |
| 4,475,591 | A | 10/1984 | Cooke |
| 4,662,442 | A | 5/1987 | Debreuille |
| 5,323,856 | A | 6/1994 | Davis et al. |
| 5,467,823 | A | 11/1995 | Babour et al. |
| 6,125,935 | A | 10/2000 | Shahin |
| 6,230,800 | B1 | 5/2001 | Bryant |
| 6,279,392 | B1 | 8/2001 | Shahin et al. |
| 6,378,610 | B2 | 4/2002 | Rayssiguier et al. |
| 6,408,943 | B1 | 6/2002 | Schultz et al. |
| 6,802,373 | B2 | 10/2004 | Dillenbeck et al. |
| 6,834,233 | B2 | 12/2004 | Economides et al. |
| 6,994,167 | B2 | 2/2006 | Ramos et al. |
| 7,219,729 | B2 | 5/2007 | Bostick et al. |
| 7,673,682 | B2 | 3/2010 | Daily |
| 2002/0179301 | A1 | 12/2002 | Schultz et al. |
| 2003/0192695 | A1* | 10/2003 | Dillenbeck et al. ..... 166/285 |
| 2004/0163807 | A1* | 8/2004 | Vercaemer ..... 166/250.12 |
| 2007/0235199 | A1 | 10/2007 | LoGiudice et al. |
| 2008/0023205 | A1 | 1/2008 | Craster et al. |
| 2009/0120640 | A1 | 5/2009 | Kulakofsky et al. |
| 2010/0044034 | A1 | 2/2010 | Bailey et al. |

OTHER PUBLICATIONS

Dictionary definitions of "switch", "electrode", "pressure switch" and "deploy", accessed on May 30, 2012 via thefreedictionary.com.*

(Continued)

*Primary Examiner* — Brad Harcourt
*Assistant Examiner* — Blake Michener
(74) *Attorney, Agent, or Firm* — Cantor Colburn LLP

(57) ABSTRACT

An apparatus for verifying cement arrival at a target location includes a liner. A sensory structure radially outwardly disposed of the liner at a target arrival location of cement from a cementing operation. The sensory structure configured to sense arrival of cement. A seal configuration automatically responsive to the sensed arrival of cement. Also included is a method for addressing micro annulus formation in a down hole cementing operation.

15 Claims, 2 Drawing Sheets

OTHER PUBLICATIONS

Botil, "Permanent Packer System" BOTIL Oil Tools India Private Limited, www.botilindia.com, India, pp. 1-2.

Offshore Magazine, "Use of Swellable Elastomers to Enhance Cementing in Deepwater", www.offshore-mag.com, vol. 68 Issue 1, Jan. 2008, PennWell Corporation, Tulsa, OK, pp. 1-2.

* cited by examiner

ARRANGEMENT AND METHOD FOR SENDING AND/OR SEALING CEMENT AT A LINER HANGER

CROSS REFERENCE TO RELATED APPLICATIONS

This application claims the benefit of an earlier filing date from U.S. Non Provisional application Ser. No. 12/195,074 filed Aug. 20, 2008, the entire disclosure of which is incorporated herein by reference.

BACKGROUND

Liner hangers in the hydrocarbon recovery industry are often cemented into a casing string or into an open hole both to keep them in place and to seal annularly around the liner hanger. While this is often effective for its intended purpose, it is known in the industry that cracks may sometimes form in the cement immediately adjacent the liner or liner hanger. These cracks form what is known as a "micro annulus" through which it is possible for gas or other fluid to migrate to a place in the well where such fluid is undesirable, or even to the surface. In general, the cracks are due to cementing procedure or composition that is inappropriate for the conditions where the cement will be installed. This may be due to operator error or to a change in conditions in the well or a lack of knowledge about the conditions in the well.

Having a micro annulus is undesirable as generally they reduce productivity of the well by contaminating the production stream or creating other problems requiring additional procedures. This causes delay; and delay, it is known, costs money. The art would therefore well receive additional apparatuses and methods that effectively address the foregoing issues.

SUMMARY

An apparatus for verifying cement arrival at a target location includes a liner; a sensory structure radially outwardly disposed of the liner at a target arrival location of cement from a cementing operation, the sensory structure configured to sense arrival of cement; and a seal configuration automatically responsive to the sensed arrival of cement.

A method for addressing micro annulus formation in a down hole cementing operation includes cementing a liner in a borehole; sensing an arrival of the cement at a target location; automatically deploying a seal into contact with the cement.

BRIEF DESCRIPTION OF THE DRAWINGS

Referring now to the drawings wherein like elements are numbered alike in the several Figures.

DETAILED DESCRIPTION

Figure 1:
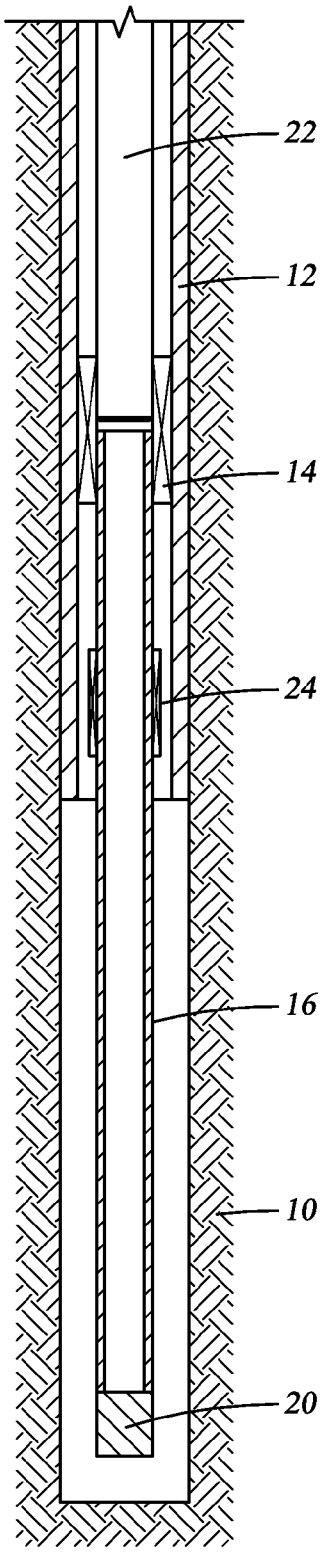
FIG. 1 is an overview of a liner hanger and liner disposed within a borehole and having an actuable annular seal.

Referring to FIG. 1, a formation 10 having a casing segment 12 therein is schematically depicted. A liner hanger 14 is disposed within the casing 12 and hangs a liner 16. In this embodiment the liner 16 is in an open hole but it is to be appreciated that the liner could be in a cased hole without affecting the operation or purpose of the invention. A liner shoe 20 is depicted at a down hole end of the liner 16 and a liner running tool 22 is depicted at an uphole end of the figure. A sensory and/or seal configuration 24 is illustrated disposed about the liner 16. The sensory and/or seal configuration 24 can function in a number of ways. In one embodiment, the configuration 24 acts as a sensory tool alone to verify arrival of cement 25 (see FIG. 2) at a target location. This embodiment assists the operator of a well in that there is a positive feedback about the position of the cement 25. This can be important to the operator since, as is known, a volume of cement is calculated from relevant information and then pumped down hole to its target location. Providing that the annulus size and shape are as expected, the calculated volume of cement will be enough to fill the annular space and the operation works well. Where however, there is a condition in the down hole target area that requires a significantly greater amount of cement, as in for example a washout, the calculated volume of cement will be insufficient to compete the cementing operation. In such a situation, feedback to the well operator would be invaluable as it will signify the need for additional cement to complete the operation or at least will alert the operator to the need for a decision as to whether a proper cementing job is needed at that location or if an incomplete job as indicated will suffice for the particular location.

Figure 2:
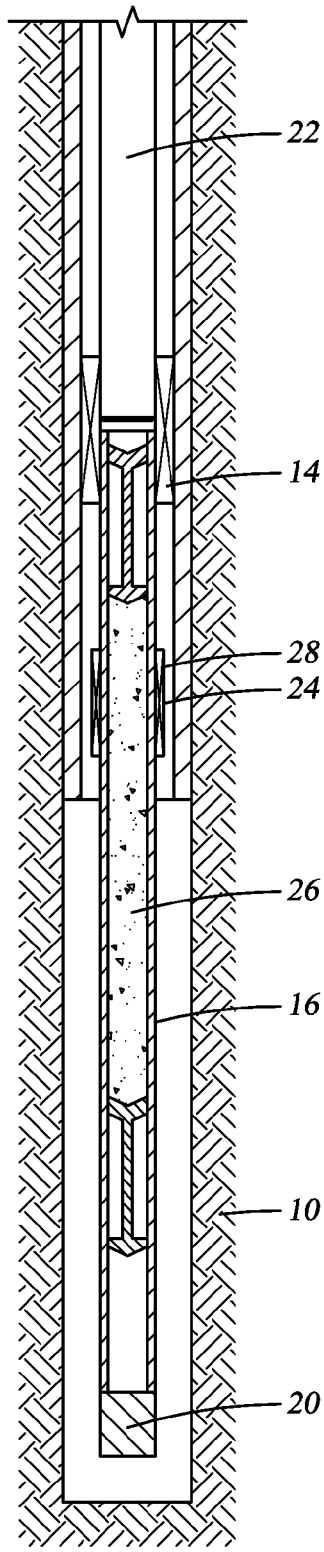
FIG. 2 is the illustration of FIG. 1 with a slug of cement illustrated between two wiper plugs being pumped down hole.
Figure 3:
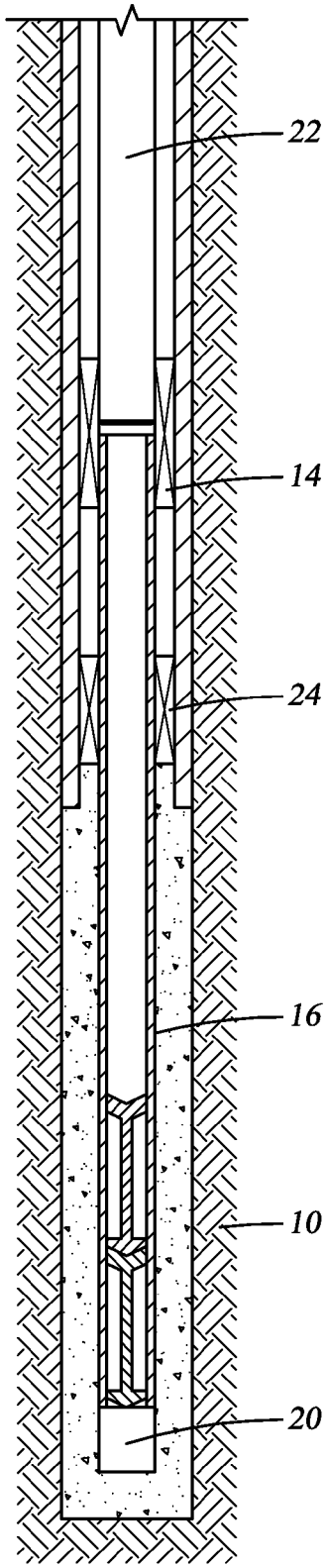
FIG. 3 is a view of the same configuration as that in FIG. 1 but with the cement having been forced into the annulus.

In one embodiment, a sensor is included that is capable of sensing the presence of cement. This can be done in a number of ways, for example, but not limited to, density measurement, alkalinity measurement, optic measurement, electrical impedance measurement across a pair of electrodes, etc. All of these and others are capable of recognizing the difference between borehole fluids and the cement 26 and therefore will provide a signal that is accurate with respect to the arrival of the cement. The sensor should be positioned proximate a planned end of cement movement. Pumping and arrival of the cement at its destination is schematically illustrated in FIGS. 2 and 3. Using the sensor and communicating the information back to the operator allows confirmation that the cementing job filled the cavity it was intended to fill or that it did not. In the event that the cement did not fill the cavity, the operator can take appropriate action as noted above. Communication of the information back to the surface in one embodiment is effected through the use of a wired pipe, such as intellipipe as the running tool 22. It is also possible to run any other type of communication conduit to the configuration 24 in order to carry a signal between the configuration 24 and a controller 28 whether proximate to or remote from the configuration 24.

Figure 4:
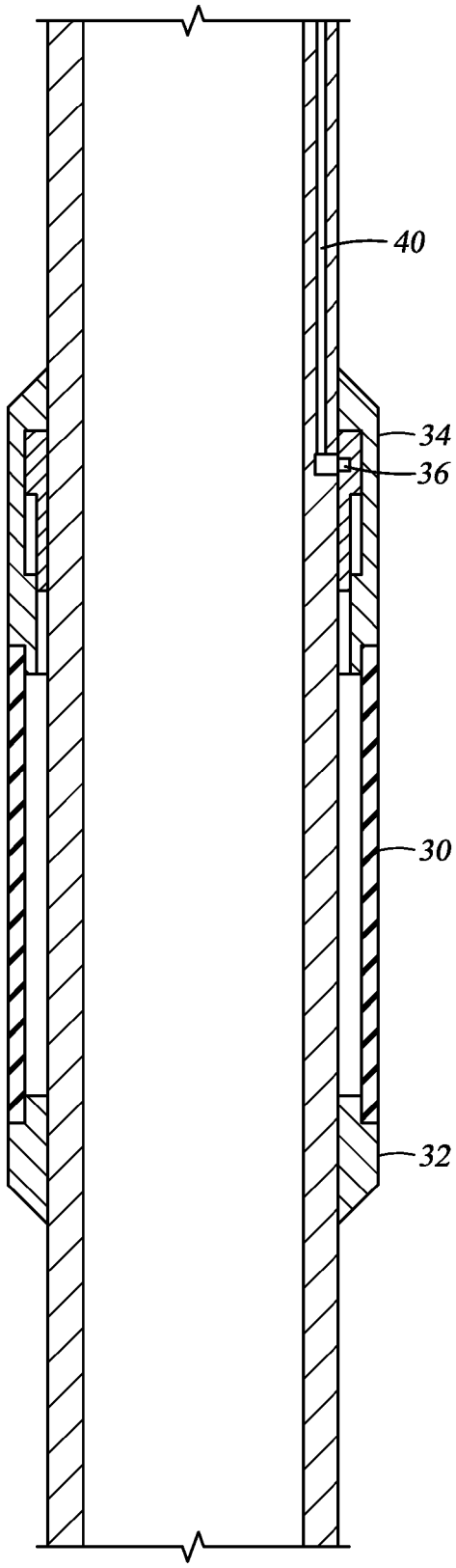
FIG. 4 is an enlarged view of a sensory and/or seal arrangement within the circumscribed area 4-4 in FIG. 3.

Referring to FIGS. 3 and 4, the capability that configuration 24 brings with respect to sensory information also makes it quite useful with respect to addressing micro annulus cracking problems. This is because the configuration 24 can be used to communicate to the operator of the well that the cement has achieved a position that is appropriate to deploy a seal member 30. Such a seal member may be set at any time after the cementing operation is complete but ideally will be set while the cement is still not beyond the green state so that the seal itself will form the cement when the seal is deployed. This ensures that a positive pressure holding seal will be created that will deadhead any fluid flowing through a micro annulus that might have been formed or might be formed in the cement.

In one embodiment, the deployment of the seal 30 is made automatic upon the sensing of cement at the target location. In this embodiment, intervention from the surface is not necessary. In another embodiment, a signal is sent to the surface where a decision on further action can be made. In yet another embodiment, a down hole controller whether remote from or adjacent to the configuration 24 can be programmed to take certain actions under certain inputs from the configuration 24.

Referring to FIG. 4, one embodiment of the configuration 24 is illustrated in a larger form to illustrate the details thereof. Seal 30 is supported by a down hole support 32 at a down hole end thereof and by an uphole support 34 at an uphole end thereof. The respective supports 32 and 34 may be dedicated supports or may be features of other components of the tool without change in their function. Seal 30 may be constructed of elastomeric material, metallic material, composite material, etc. providing that it has properties enabling it to increase in a radially outward dimension, or otherwise into the cement, upon actuation. In one embodiment, the seal is an inflatable seal whereas in other embodiments the seal could be mechanically actuated through, for example, axial compression. In any case, the seal 30 is not actuated until cement from the cementing operation reaches a sensory structure 36 of the configuration 24, which while it may be positioned anywhere on the configuration 24, is particularly beneficially placed downstream of the seal 30 (in the direction of cement travel) to ensure that when the cement is detected, the seal is already covered in the cement. The sensory structure 36 is operably connected to a decision making controller which may be a down hole controller, uphole controller, controller at the surface or an operator. The connection may be wired as indicated at 40 or may be wireless.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. An apparatus for verifying cement arrival at a target location comprising:

a liner;

a sensory structure radially outwardly disposed of the liner at a target arrival location of cement from a cementing operation, the sensory structure configured to sense arrival of cement; and a seal configuration automatically expanded radially from an inactive position to a deployed position responsive to the sensed arrival of cement.

2. The apparatus as claimed in claim 1 further comprising a communication conduit in operable communication with the sensory structure.

3. The apparatus as claimed in claim 2 wherein the communication conduit is a wire.

4. The apparatus as claimed in claim 1 wherein the sensory structure is a pair of electrodes.

5. The apparatus as claimed in claim 1 wherein the sensory structure is a magnetostrictive element.

6. The apparatus as claimed in claim 1 wherein the sensory structure is a Hall effect sensor.

7. The apparatus as claimed in claim 1 wherein the sensory structure is a density sensor.

8. The apparatus as claimed in claim 1 wherein the sensory structure is an alkalinity sensor.

9. The apparatus as claimed in claim 1 wherein the seal configuration is located relative to the sensory structure such that in use the seal will be upstream of the sensory structure relative to a direction of cement movement.

10. The apparatus as claimed in claim 1 wherein the sensory structure is configured to communicate with a controller.

11. The apparatus as claimed in claim 10 wherein the controller is an operator at surface.

12. The apparatus as claimed in claim 10 wherein the controller is located in the down hole environment.

13. The apparatus as claimed in claim 10 wherein the controller is at the sensory structure.

14. The apparatus as claimed in claim 10 wherein the controller is programmed to effect the automatic deployment of the seal after receiving a signal from the sensory structure.

15. A method for addressing micro annulus formation in a down hole cementing operation comprising:

cementing a liner in a borehole;

sensing an arrival of the cement at a target location; and automatically radially expanding a seal from a previously inactive position into contact with the cement.

* * * * *